US005480225A

United States Patent [19]

Bailey

[11] Patent Number: 5,480,225

[45] Date of Patent: Jan. 2, 1996

[54] FOLDABLE DISPLAY BOOTH

[76] Inventor: Randall J. Bailey, 176 Elizabeth St., Atlanta, Ga. 30307

[21] Appl. No.: 166,926

[22] Filed: Dec. 14, 1993

[51] Int. Cl.[6] ..... A47B 43/00

[52] U.S. Cl. ..... 312/258; 312/114

[58] Field of Search ..... 312/138.1, 258, 312/324, 329, 244, 234, 114, 249.8; 108/99, 100

[56] References Cited

U.S. PATENT DOCUMENTS

| | | | |
|---|---|---|---|
| 734,645 | 7/1903 | Winfield | 108/99 |
| 1,336,899 | 4/1920 | Gallagher | 312/258 |
| 1,826,102 | 10/1931 | Towne | 312/257.1 |
| 2,222,318 | 11/1940 | McLaughlin | 312/152 |
| 2,617,550 | 11/1952 | Lang | 217/11 |
| 2,749,577 | 6/1956 | Zaninovich | 20/1.6 |
| 3,132,439 | 5/1964 | McGill | 312/244 |
| 3,684,103 | 8/1972 | Belinder | 211/177 |
| 4,082,388 | 4/1978 | Goeglein | 312/258 |
| 4,417,774 | 11/1983 | Bevan et al. | 312/108 |
| 4,601,524 | 7/1986 | Ytter | 312/114 |
| 5,199,775 | 4/1993 | Morgan et al. | 312/257 |

*Primary Examiner*—Kenneth J. Dorner
*Assistant Examiner*—Gerald A. Anderson
*Attorney, Agent, or Firm*—Jones & Askew

[57] ABSTRACT

A foldable display unit having sections hingedly connected to a base wherein when the sections pivot inwardly toward the base, the sections and base fold into a self-contained portable shipping container. The unit includes a base, front section and top sections hingedly connected thereto. The top surface of the base is configured to nestingly receive the front and top sections when they are folded. The unit may also have side sections hingedly connected thereto. The side sections extend outwardly from the sides of the base in an unfolded state and pivot inwardly toward the sides of the base so that the sides are in face to face relation with the side surfaces of the base. Latching mechanisms secure the hingedly connected sections to the base when the unit is folded.

4 Claims, 7 Drawing Sheets

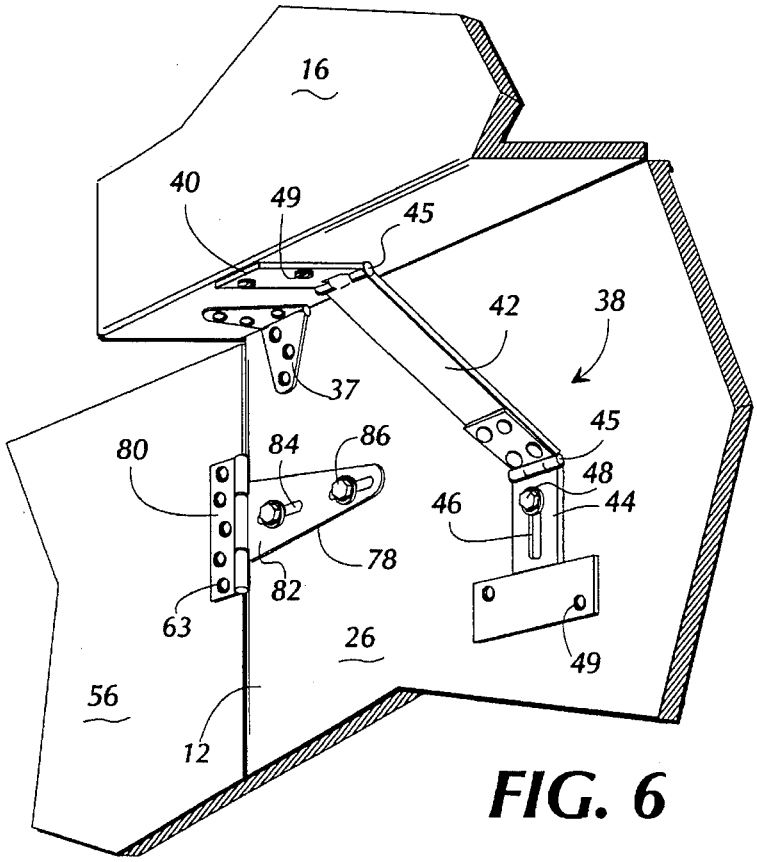
FIG. 6
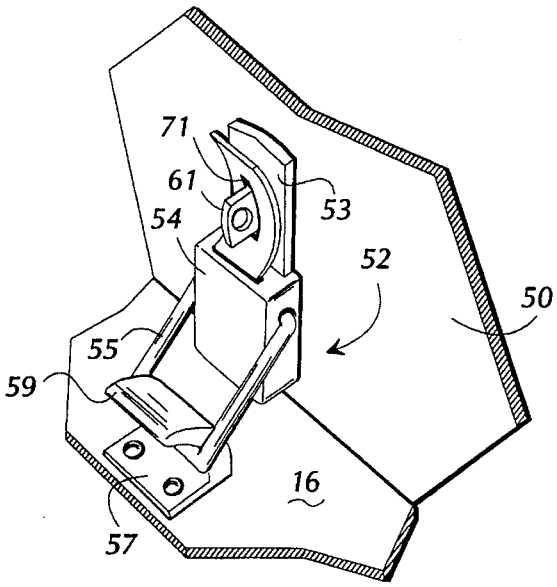
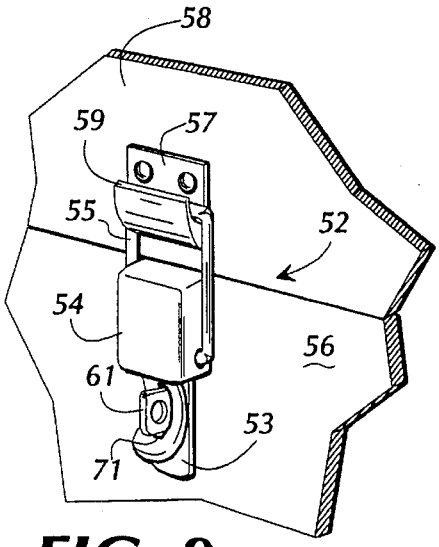
FIG. 8
FIG. 7

FOLDABLE DISPLAY BOOTH

TECHNICAL FIELD

The present invention relates generally to a display booth, and relates more specifically to a self-contained display booth that enables a user to disassemble and assemble the display booth single-handedly.

BACKGROUND OF THE INVENTION

Conventions and trade shows are opportunities for businesses, industries and other organizations to exchange information as well as promote and sell goods or services. At these events, exhibitors offer promotional literature and goods to potential customers to induce such customers to purchase their goods and/or services. Exhibitors at such events compete with one another for the attention of potential customers for potential sales. This is often accomplished by heightening marketing efforts and improving upon the appearance of exhibitors' booths or display areas at such events. Having a well designed booth that effectively catches the attention of potential customers is important to exhibitors and impacts an exhibitor's sales at such events.

Many exhibitors attend a multitude of trade shows and conventions throughout the year. Because many convention and trade show exhibitors travel to multiple events each year, many purchase their own display materials and move them from one event to another. Some exhibitors own their own display booths which must be assembled and disassembled at each event. Such booths enable the exhibitor to design the display ahead of time. Most booths or display materials must be placed in separate shipping containers and shipped to the location of a particular event. Once the containers arrive, the event personnel typically deliver the containers to the exhibitor at an assigned display area. Then, the exhibitors assemble the display booth, usually with the aid of the event personnel. Such an arrangement is extremely time consuming because the assembly or disassembly of an exhibitor's display area is often dependent upon the event personnel employed to deliver the containers of display materials to event exhibitors and to assist exhibitors in assembling and disassembling the display areas. If the event personnel are understaffed, exhibitors are forced to wait for the event personnel to send or retrieve their shipping containers for their display booths and assist them with the assembly and disassembly.

Many events operate under a "first in, last out" rule wherein an exhibitor that is fortunate to have its containers delivered to the display area early for assembly, will most likely be one of the last exhibitors to receive the containers at the end of the event for disassembly. This arrangement is frustrating to exhibitors because many times an exhibitor is traveling from one event to another with little time to spare. If the event personnel deliver their containers and disassemble their display area late, that exhibitor may be late in arriving at the next event. Moreover, if the display materials are shipped to an event in a container, there is always the risk that the shipper will lose some or all of the contents of the container. When this happens, the exhibitor is without any display materials or even without a display booth. This can result in considerable lost sales opportunities. Moreover, if the contents of the container include one of a kind items, such as a demonstration model, these items may not be easily replaced.

Thus, it would be advantageous to have a self-contained display unit for use at trade shows and conventions where the display unit stores display items during shipping. Moreover, it would be desirable to have a display unit or booth that folds itself into its own shipping container. This would eliminate the need for exhibitors to depend upon the event personnel to deliver and retrieve their shipping containers. In addition, it would be beneficial to have a foldable display booth that can be folded and unfolded by a single person without substantial effort and without the need for many tools. This would also eliminate the need for assistance from event personnel or others to disassemble and assemble the display area.

At present there are some display structures that can to be assembled and disassembled from a plurality of separate parts and stored in a shipping container that is reconfigured from a portion of the display structure. U.S. Pat. No. 4,082,388 discloses a display booth having a plurality of elongated wall sections that fold to form an enclosure. A channel is removably fitted over the upper edge of the wall sections and a similar channel is removably fitted over the lower edges of the wall sections to secure and align the wall sections. The wall sections are secured to a display cabinet. The display booth may be disassembled by removing the channel pieces and wall sections. These pieces may be reconfigured to form an enclosure for the disassembled pans of the display booth and thus form a self-contained shipping crate for the entire booth.

There are other display devices that have some or no folding capability. U.S. Pat. No. 2,222,318 discloses a foldable case. The case has a front section hinged to a rear section along the top surface. When the front section is unfolded 180° upward relative to the rear section, it rests on top of the rear section. U.S. Pat. No. 2,617,550 discloses a display device having a first box hingedly connected to a second box. The first box, or base, is hinged to the second box along the top front surface. The second box, when unfolded, moves 180° upward relative to the first box so as to rest on top of the first box. The second box has a top section hinged thereto that moves 180° upward relative to the second box to rest atop the second box.

U.S. Pat. No. 3,684,103 discloses a portable, but uncollapsible display exhibit. The device consists essentially of a back drop structured by various panels secured to each other and further consists of hinged shelves that have collapsible support structure located beneath the shelf. This type of a display device requires complete assembly and is packed and shipped in a separate container.

U.S. Pat. No. 4,601,524 discloses a display device having a base and a top section. The top section has a top display section hinged to a top base. In a folded position, the top display section nests in an upside down position with the base section. The top base section is hinged to the base section of the display device. In an unfolded position, the top display section moves upwardly 180° to be flush against the top base section and the top base section moves 90° into a vertical position above the base. The display sections are designed to have lights mounted therein and translucent artwork mounted thereon so that the artwork is illuminated from within the top display sections. The base of the display device is designed to have a slide projector and slide carousel mounted therein so that the slides are projected onto a screen located at the front of the base.

U.S. Pat. No. 4,417,774 discloses a collapsible display booth having front and rear boxes. The front box consists of a front display sign and front display booth. The display device is unfolded by lifting the front sign up on two posts that rest within recesses within the booth portion of the front box. The rear box includes a base and display portion hinged thereto. When unfolded, the display portion of the rear box rotates upwardly 180° to rest upon the base portion of the rear box. The front and rear boxes are joined by securing hinged doors of the front box to the rear box.

U.S. Pat. No. 5,199,775 discloses a display unit having a front display unit base and overhead display unit sign. The display device also includes a back drop. The display device is secured by supporting frames in spaced parallel position that are assembled behind the display device. The device is capable of being assembled and disassembled, but does not fold upon itself and must be shipped in a separate container.

In addition to the display devices described above, there are known portable containers having some display capability. For example, U.S. Pat. No. 2,749,577 discloses a container having a pair of doors on the front surface of the container. The doors are hinged to the side and open outwardly. Shelves are mounted to the interior surface of the doors so that when the doors are opened relative to the front surface of the container, they provide a display shelf. U.S. Pat. No. 1,826,102 discloses a portable container having doors that comprise the front surface of the container. The doors are hinged to the side sections of the container and open outwardly. A rack or series of shelves is fixedly mounted within the interior of the container and may be seen when the doors of the front surface are opened.

None of the display devices presently known completely and easily fold into a self-contained shipping container. Moreover, none of the known containers unfold into an attractive and effective display booth. None of the known shipping containers unfold completely so that there are no shipping container surfaces showing when the display booth is completely unfolded. Conversely, there are presently no known shipping containers capable of folding into a display booth where the display booth surfaces are completely hidden when the booth is completely folded.

Thus, there is a need for a display booth capable of folding into a self-contained shipping container.

There is a further need for a display booth that is easily assembled and disassembled.

There is still a further need for a foldable display booth that folds itself into a self-contained shipping container, wherein the surfaces of the shipping container are completely hidden when the booth is unfolded.

There is yet a further need for a foldable display booth that folds into a self-contained shipping container wherein the booth surfaces are hidden from the exterior when the booth is completely folded into the shipping container.

There is an even further need for a foldable display booth that folds into a self-contained shipping container having the capability to store display items within the container when folded.

SUMMARY OF THE INVENTION

As will be seen, the present invention overcomes these and other disadvantages associated with prior art display devices. Stated generally, the present invention is directed to a foldable display unit comprising a base, a front section and a top section. The front and top sections are hinged to the base. The base has a front surface, a top surface, a rear surface and side surfaces. The front section is hinged to the front surface of the base. The top section is hinged to the rear surface of the base. The top surface of the base is configured to nestingly receive the front and top sections hinged thereto. The front and top sections are shaped to remain within the exterior of the base when folded.

Optionally, the unit may also include side sections removably hinged to the rear surface of the base. The side sections are configured to conform to the shape of the side of the base when folded.

To unfold the display unit, the front section pivots about its hinges 180° forward relative to the base so that the front section is adjacent to the front surface of the base. The top section pivots about its hinges 90° upward relative to the base to rest on top of the base. Each side section pivots about its hinges 90° outward relative to the side surfaces of the base thereby forming an attractive display unit.

To fold the display unit, the front section pivots about its hinges 180° upward to rest on the top surface of the base and to function as a support for the top section. The top section pivots about its hinges 90° downward to rest on the top surface of the base and on a portion of the front section. The side sections pivot about their hinges 90° inward to rest adjacent to the side surfaces of the base, thereby forming a completely folded display and storage unit.

The display unit may be easily assembled and disassembled by a single person thereby eliminating the dependency on outside personnel to remove or retrieve a separate shipping container. Moreover, the only tool needed to assemble and disassemble the unit is a wrench. In addition, because the unit is capable of easy assembly and disassembly, it eliminates the need for additional assistance from outside personnel. Moreover, when the display unit is completely folded there are no display surfaces on the exterior of the unit that could be damaged during shipping. Conversely, when the unit is completely unfolded, there are no exterior surfaces showing which could compromise the quality of the display appearance. In addition, the base is hollow and serves as a storage area which is accessible from the rear surface of the base even when the unit is completely folded. This enables the stored items to be accessible after the display unit has been folded and prepared for shipping.

Accordingly, it is an object of the present invention to provide a foldable display unit capable of folding into its own shipping container.

It is a further object of the present invention to provide a display unit that is easily assembled and disassembled by one person.

It is yet a further object of the present invention to provide a foldable display unit that folds into a self-contained shipping container, wherein the exterior surfaces of the unit are completely hidden when the unit is in its unfolded state.

It is still a further object of the present invention to provide a foldable display unit that folds into a self-contained shipping container wherein the interior surfaces of the unit are completely hidden from the exterior when the unit is in its folded state.

It is even yet a further object of the present invention to provide a foldable display unit capable of storing display items within the container when the unit is folded.

These and other objects, features and advantages of the present invention will become apparent upon reading the following detailed description of the preferred embodiment of the invention, when taken in conjunction with the drawings and appended claims.

BRIEF DESCRIPTION OF THE DRAWINGS

The invention will now be described with reference to the accompanying drawings, which illustrate a preferred embodiment of the foldable display unit, falling within the scope of the appended claims, and in which:

FIG. 6 is a detailed perspective view of a portion of the display unit shown in FIG. 5 wherein the top section of the unit is unfolded and oriented vertically.

FIG. 7 is a detailed perspective view of a portion of the display unit shown, in FIG. 5 wherein the sign section is unfolded and oriented vertically relative to the top section.

FIG. 8 is a detailed perspective view of a portion of the display unit shown in FIG. 5 wherein the upper portion of the side section is unfolded and oriented vertically relative to the lower portion.

DETAILED DESCRIPTION OF THE INVENTION

Figure 1:
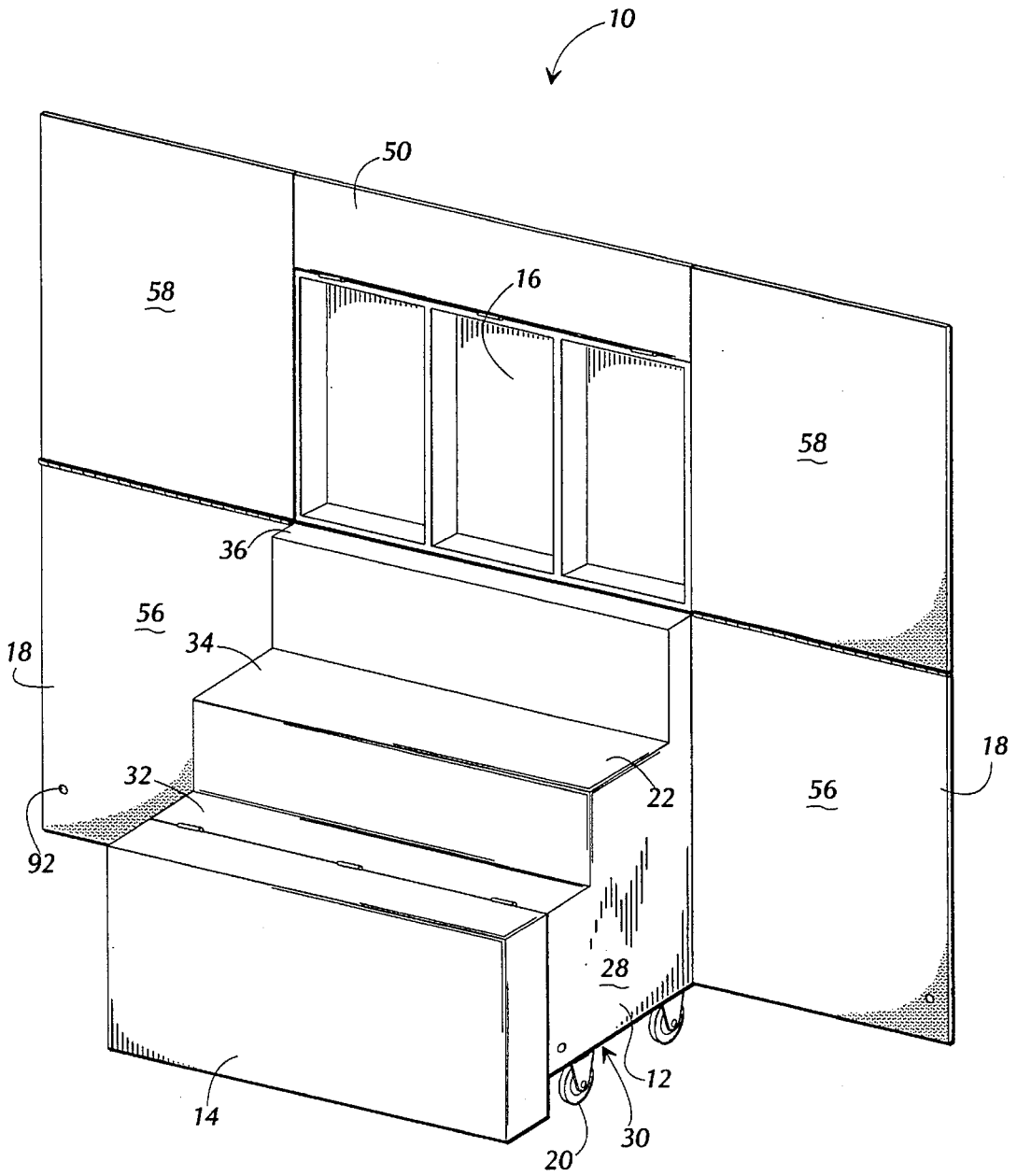
FIG. 1 is a perspective view of a foldable display unit, in its unfolded state, according to the preferred embodiment of the invention.

Referring now to the drawings in which like numerals indicate like parts throughout the views, the preferred embodiment of the present invention will first be described structurally in its unfolded state and then be described as it is folded.

Structure of the Display Unit

Turning first to FIGS. 1–5, a foldable display unit 10 is shown in its unfolded state. The unit 10 comprises a base 12, a front section 14, a top section 16 and side sections 18. The base 12 has a top surface 22, a front surface 24, a rear surface 26, side surfaces 28, and a bottom surface 30. The base 12 has casters 20 extending downwardly from the bottom surface 30. The top surface 22 of the base 12 has three steps: a front step 32, a middle step 34, and a rear step 36. The steps are shaped to nestingly receive portions of the front section 14 and top section 16 when the unit 10 is folded.

The front section 14 is hinged to the front surface 24 of the base 12. In its unfolded state, the front section 14 rests adjacent to the front surface 24 of the base 12. The width of the front step 32 of the base 12 is approximately the same as the width of the front section 14 so when the unit 10 is folded, the top of the front section 14 rests on top of the front step 32, and the remaining dimensions of the front section are flush with and do not extend beyond the exterior dimensions of the base 12.

Figure 5:
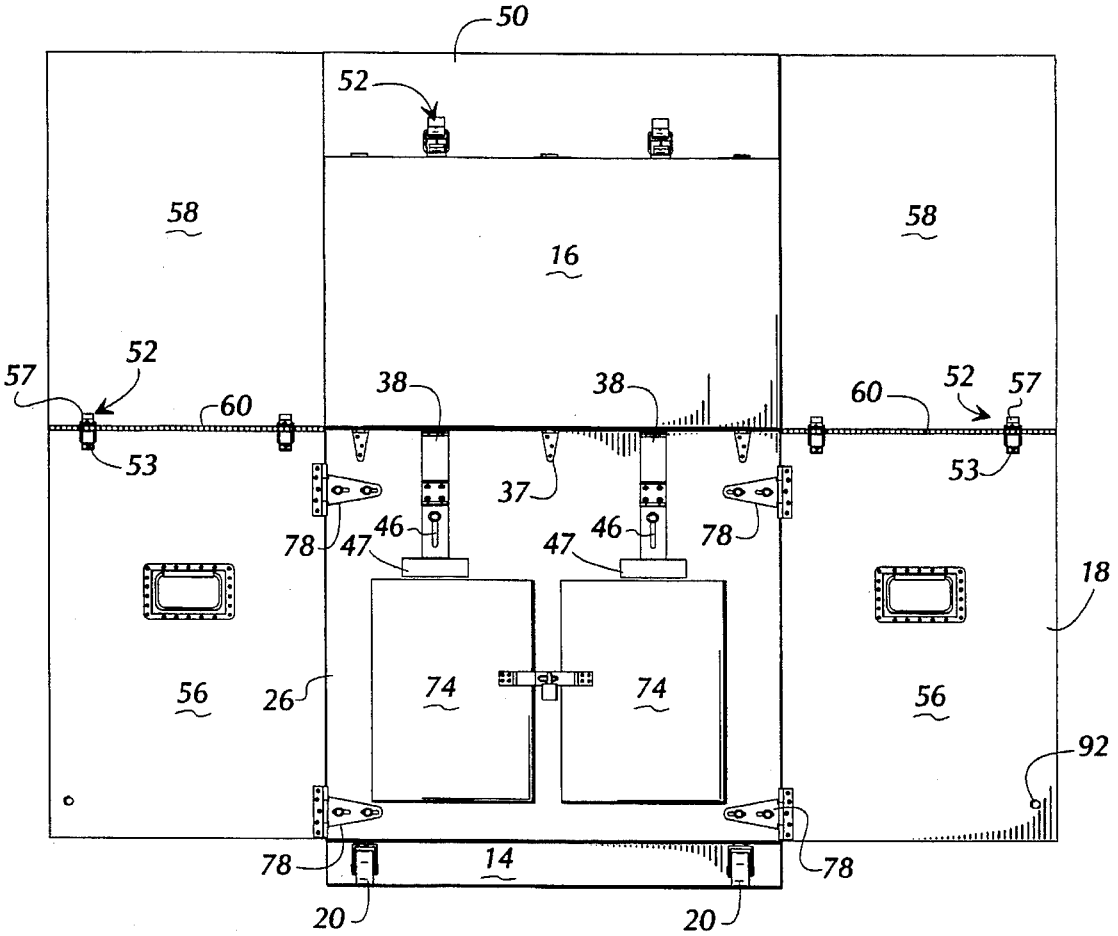
FIG. 5 is a rear view of the display unit shown in FIG. 1.

The top section 16 is joined to the base 12 along the rear surface 26 of the base 12 by means of conventional strap hinges 37 and two support hinges 38, as shown FIGS. 5 and 6. FIG. 6 provides a detailed view of the support hinges 38. Each support hinge 38 includes a first leaf 40, a second leaf 42, a third leaf 44 and hinge pins 45. The first leaf 40 of the support hinge 38 is secured to the rear of the top section 16. The second leaf 42 of the support hinge 38 is joined to the first and third leaves 40, 44 by means of the hinge pins 45. The third leaf 44 has a vertical slot 46 therethrough. The first leaf 40 is secured to the top section 16 by bolts 49 and the third leaf 44 is also secured to the rear surface 26 of the base 12 by means of bolts 49. An adjustment bolt 48 is located within the vertically oriented slot 46. The position of the top section 16 relative to the base 12 may be adjusted by loosening the adjustment bolt 48 with a wrench (not shown) so as to allow the third leaf 44 to move along the slot 46 in a vertical direction. When the top section 16 is oriented substantially vertical, the third leaf 44 moves downward so that the second leaf 42 acts as a support beam and is oriented at an approximate 45° angle from the vertical. The position of the top section 16 relative to the base 12 is secured by tightening the adjustment bolt 48 that slides within the slot 46. When the third leaf 44 has traveled downwardly as far as possible within the slot 46, a stop plate 47 fixed to the rear surface of the base 12, supports the third leaf and prevents any further downward movement of the third leaf. The top section 16 may be partitioned into shelves or compartments or the like as shown in FIG. 1, to accommodate the display needs of the exhibitor. The top section 16 may also have lights mounted therein and/or translucent artwork mounted thereon so that the artwork is illuminated from within the top section.

Figure 4:
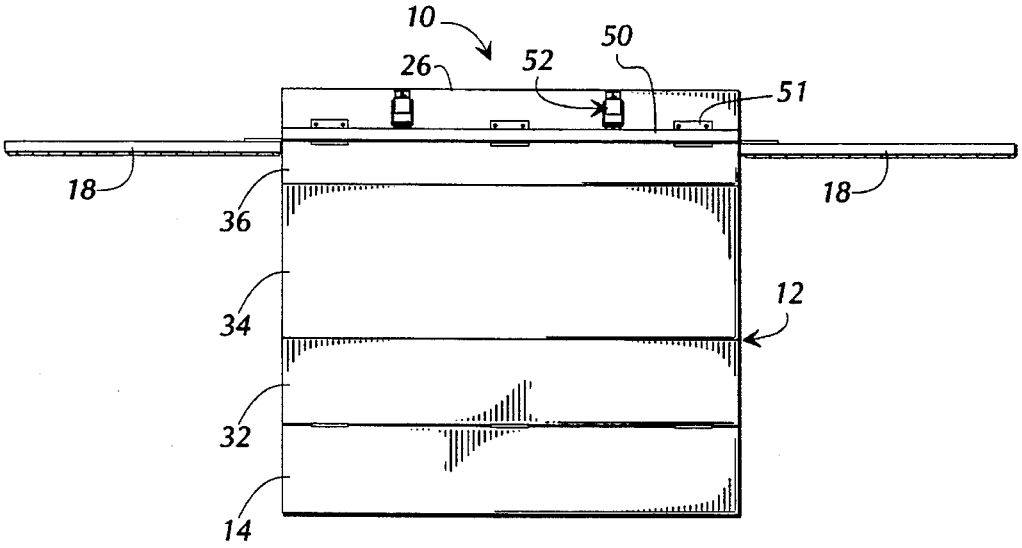
FIG. 4 a top view of the display unit shown in FIG. 1.
Figure 12:
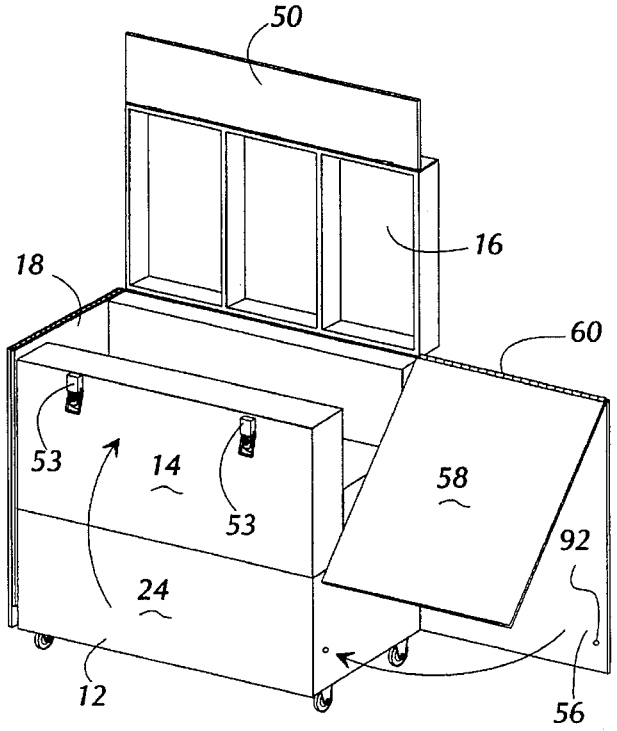
FIG. 12 is a perspective view of the display unit shown in FIG. 11 wherein the side sections are folded into the base.
Figure 13:
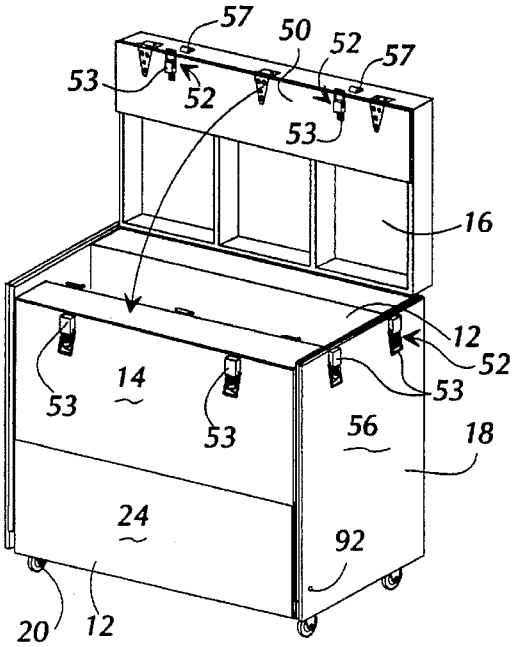
FIG. 13 is a perspective view of the display unit shown in FIG. 12 wherein the front and top sections are folded into the base.

The top section 16 has an additional sign section 50 that is hinged by means of conventional butt hinges 51 to the top of the top section 16 in its unfolded position, as shown in FIG. 4. The sign section 50 is held vertically upright with respect to the top section 16 by a toggle latch mechanism 52 as shown in detail in FIG. 7. The toggle latch mechanism 52 includes a latch plate 53 secured to the top section 16 in an unfolded state, as shown in FIG. 7. A latching lever 54 is hinged to the latch plate 53. A latching hook 55 is hinged to the latching lever 54. A catch plate 57 is fastened to the sign section 50. The catch plate 57 has a nib 59. To fasten the sign section 50 in vertical position relative to the top section 16, the latching lever 54 is pivoted toward the catch plate 57 so that the latching hook 55 is received into the nib 59 of the catch plate. The latching lever 54 is then moved adjacent to the latch plate 53. A catch plate 57 is also mounted to the front surface of the base 12 so that the top section 16 is secured to the base by means of the toggle latch mechanism 52 when the unit 10 is folded, as shown in FIG. 12. The latch plate 53 has a loop 61 extending therefrom. The latching lever 54 has a slot 71 therein which receives the loop 61 when the latching lever is in its latched position. The hole in the loop 61 receives a padlock, chain or the like to secure the latching mechanism 52 when the unit 10 is folded.

Figure 9:
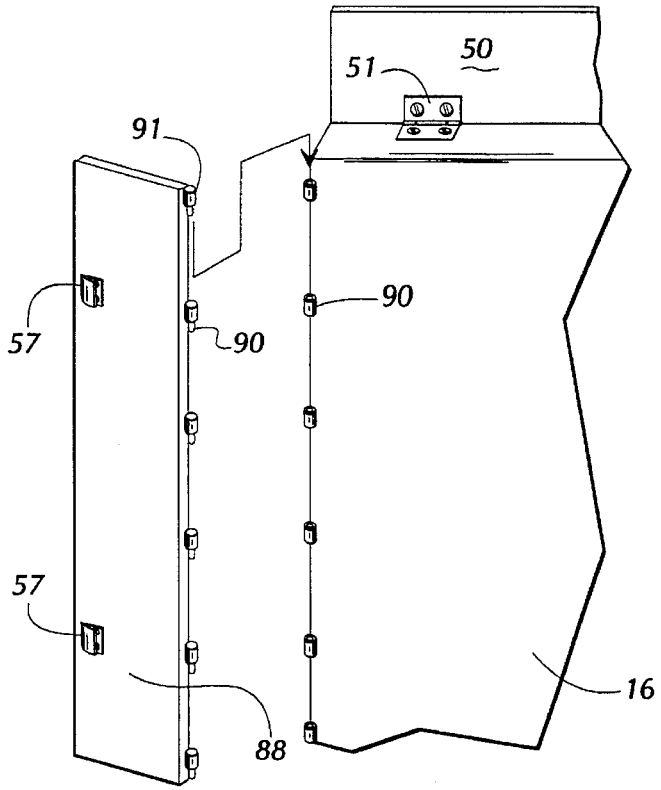
FIG. 9 is a detailed perspective rear view of the display unit shown in FIG. 5 wherein the side flaps disengage from their hinges.

As shown in FIGS. 4 and 5, the top section 16 also has side flaps 88 that protect the side surfaces of the top section when the unit 10 is folded. The side flaps 88 are substantially rectangular and flat and dimensioned to conform to the sides of the top section 16 when the unit 10 is folded. Each side flap 88 is joined to the top edge of the top section 16 by means of sliding pin hinges 90, shown in detail in FIG. 9. The sliding pin hinges 90 have fixed pins 91 extending from one side of the hinge. The other side of the hinge slidably receives the fixed pins 91 therein. When the unit 10 is unfolded, the side flaps 88 slide on the pins 91 of the sliding pin hinges 90 until the side flap disengages from the pin of the sliding pin hinge. The side flap 88 is then stored within the base 12 while the unit 10 is unfolded.

Figure 2:
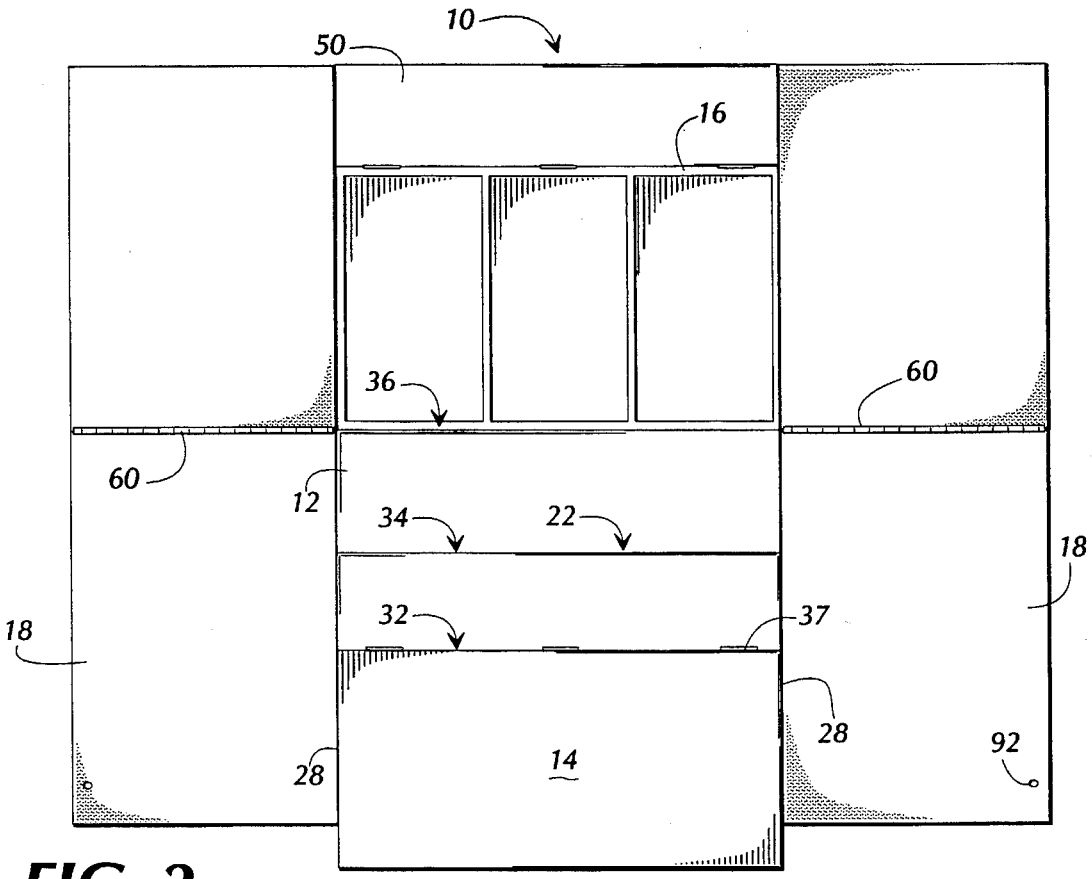
FIG. 2 is a front view of the display unit shown in FIG. 1.
Figure 3:
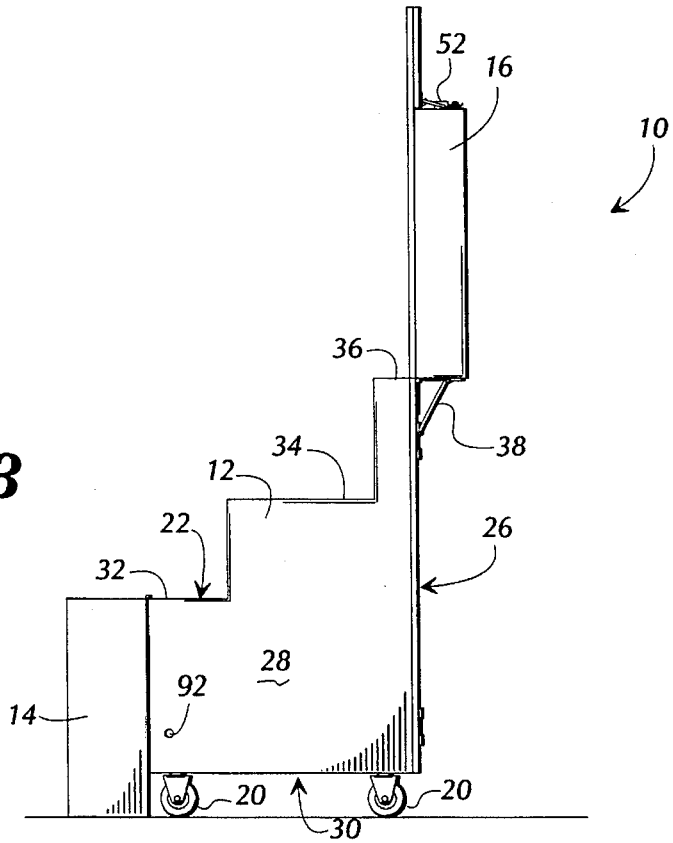
FIG. 3 is a side view of the display unit shown in FIG. 1.

Returning to FIG. 1, each side section 18 comprises a lower portion 56 and an upper portion 58. Both portions are substantially rectangular and flat and have substantially the same dimensions as the side surfaces 28 of the base 12. The lower portion 56 is hinged to the upper portion 58 by means of continuous hinges 60, as shown in FIG. 2. The lower portion 56 is flush against the upper portion 58 when the unit 10 is in its folded state. The side sections 18 are totally extended to their full height by rotating the upper portion 58 of the side section 18 approximately 180° upward from the lower portion 56.

The side sections 18 are secured in a vertical position by the toggle latch mechanism 52 attached to the lower and upper portions respectively. The operation of the toggle latch mechanism 52 in securing the position of the upper portion 58 relative to the lower portion 56 is similar to that described in detail above with regard to the sign section 50. The latch plate 53 is secured to the lower portion 56 and the catch plate 57 is secured to the upper portion 58, as shown in FIG. 8.

Two horizontally adjustable hinges 78 connect each lower portion 56 of the side section to the base 12. The horizontally adjustable hinges allow for horizontal movement of the side sections 18 during folding and unfolding of the unit 10. The horizontally adjustable hinge 78, shown in detail in FIG. 6, includes a frame leaf 80 secured, by means of screws 63, to the upper end of the lower section 56 along the edge adjacent to the side surface 28 of the base 12. A center leaf 82 is slidably attached to the rear surface 26 of the base 12. The center leaf 82 has a pair of horizontally oriented slots 84 and threaded rods 86 within the slots. Once the position of the side section 18 is determined, the threaded rods 86 are tightened to secure the side section 18 in place.

Because each side section 18 unfolds from the upper and lower portions 58, 56, the horizontally adjustable hinges 78 must be adjusted horizontally to eliminate any gap therebetween. The horizontally adjustable hinges 78 must also be capable of moving the side sections 18 outward to accommodate the thickness of the upper portion 58 folded against the lower portion 56 when the unit 10 is in its folded state.

As stated above, the toggle latch mechanisms 52 are used to secure the upper portion 58 in a vertical position relative to the lower portion 56. The toggle latch mechanisms 52 are also used to secure the side sections 18 to the top section 16 when the unit 10 is folded. The latch plate 53 of the toggle latch mechanism 52 is attached at two places to the exterior surface of the lower portion 56 of each side section 18, as shown in FIG. 5. Catch plates 57 are mounted to the side flaps 88 at similar locations to ensure alignment with the latch plates 53 attached to the lower portion 56 of each side section 18 when the unit 10 is folded. The catch plates 57 on the side flaps 88 receive the latching hooks 55 on the latch plates 53 mounted to the lower portion 56 to secure the side sections 18 to the top section 16 when the unit 10 is folded.

Figure 10:
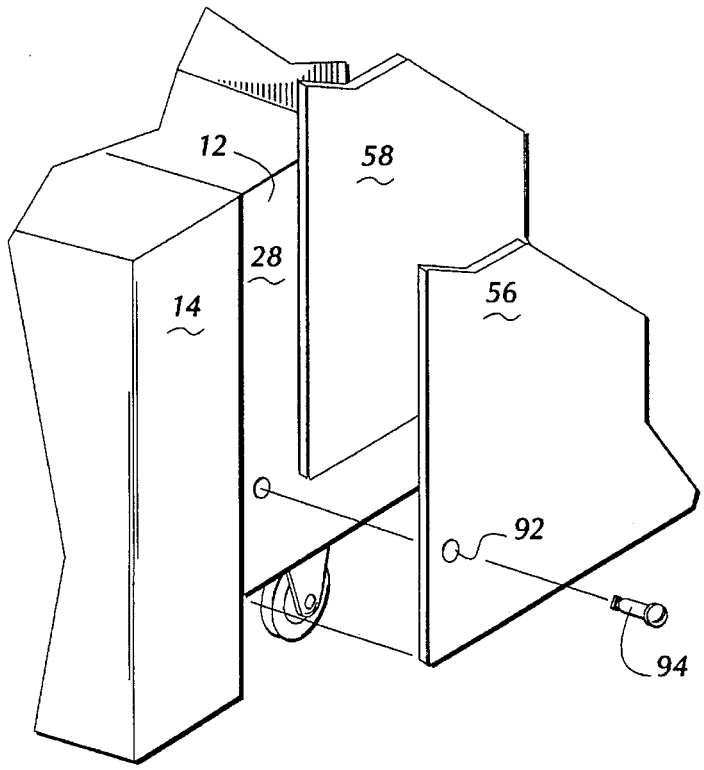
FIG. 10 is a detailed perspective view of a portion of the folded side section of the preferred embodiment of FIG. 1.

The lower portion 56 has a hole 92 therethrough located so that when the lower and upper portions are folded, the hole aligns with a similar hole in the side surface 28 of the base 12, as shown in detail in FIG. 10. The aligned holes 92 receive a turn fastener 94 to secure the side section 18 to the base 12 when the unit 10 is folded. When the unit 10 is unfolded, the fastener 94 rests within the hole 92 in the lower portion 56.

Returning now to FIG. 5, the rear surface 26 of the base 12 has a pair of cabinet doors 74 hinged to the base 12 that open outwardly. These doors 74 enable the user to store any display items in the base 12, and other items such as the side flaps 88 when the unit 10 is unfolded. In addition, the cabinet doors 74 enable the user to have access to the display items after the unit 10 has been completely folded.

Folding the Display Unit

Figure 11:
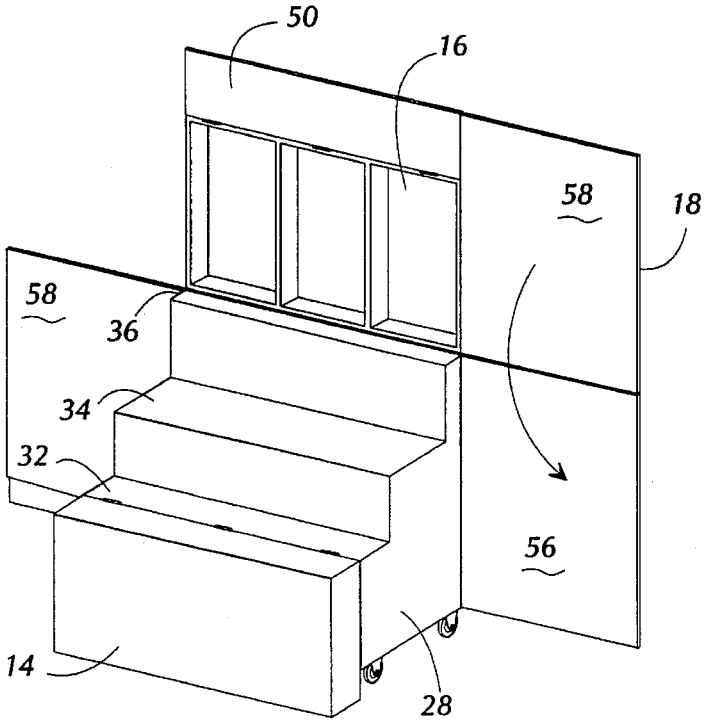
FIG. 11 is a perspective view of the display unit shown in FIG. 1 wherein the side sections are folded; lo

To fold the unit 10, the upper portion 58 of each of the side sections 18 is folded against the lower portion 56, as shown in FIG. 11. This is accomplished by causing the latching lever 54 to disengage from the latching plate 53, which is attached to the lower portion 56 of the side section 18. The latching hook 55 clears the nib 59 of the catch plate 57 attached to the upper portion 58 of the side section 18. Once both of the toggle latch mechanisms 52 disengage, the upper portion 58 is folded over the lower portion 56 so that the display surfaces of the upper and lower portions contact one another.

The horizontally adjustable hinges 78 that connect the lower portion 56 of one of the side sections 18 to the base 12 is unlocked by loosening the threaded rods 86 that slide within the horizontally oriented slot 84 within the center leaf 82. Once both horizontally adjustable hinges 78 are loosed on one side section 18, the side section can move horizontally outward, away from the base 12. This is done to accommodate the thickness of the folded upper portion 58 against the lower portion 56. The folded side section 18 pivots 90° inward toward the side surface 28 of the base 12 about the horizontally adjustable hinges 78. The process described above is repeated to fold the other side section 18. The turn fastener 94 resting in the hole of the lower portion 56 is inserted into the aligned hole 92 in the base 12. The turn fastener 94 is rotated so flint it is secure within the aligned hole 92 so as to ensure that each side section 18 remain secure against the base 12 when the unit 10 is shipped.

Turning now to FIG. 12, the front section 14 folds by pivoting upwardly 180° relative to the base 12 so that the top of the front section is nested on the front step 32 of the base. When the front section 14 is folded it supports a portion of the top section 16 in its folded position.

The top section 16 is folded by first joining the side flaps 88 to the top section. The side flap 88 is slidingly received onto the sliding pin hinge 90. Then, the toggle latch mechanism 52 that secures the sign section 50 to the top of the top section is disengaged. This allows the sign section 50 to pivot 180° downward to rest flush against the front of the top section 16.

The top section 16 is then folded onto the base 12 by first loosening the adjustment bolt 48 within the vertically oriented slot 46 on the frame leaf 40 of one of the support hinges 38. Once the adjustment bolts 48 in both support hinges are loosened, the top section 16 rotates 90° in a forward direction relative to the base 12 to rest on the rear step 36 of the base and on the front section 14. Once the top section 16 is folded, it is secured to the front section 14 by means of the toggle latch mechanisms 52. The latching hook 55 hinged to the latch plate 53 attached to the top of the top section 16 engages the nib 59 of the catch plate 57 mounted to the front of the front section 14. The side sections 18 are secured to the base 12 by inserting the turn fastener 94 in the aligned holes 92. The turn fastener 94 is rotated within the hole 92 to prevent the fastener from sliding out of the hole 92. The completely folded unit 10 is shown in FIG. 14.

Figure 14:
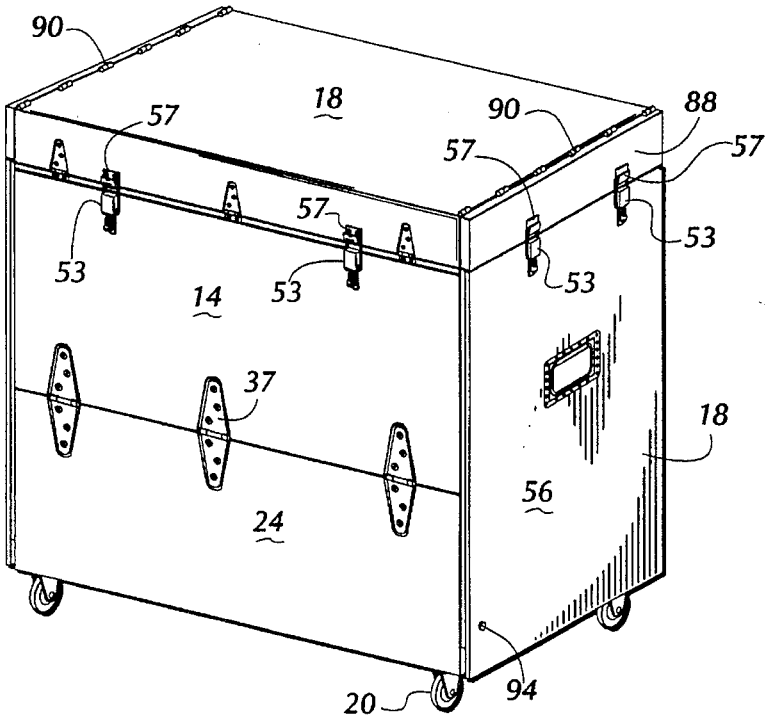
FIG. 14 is a perspective view of the display unit in a completely folded position.

As can be seen by comparing FIGS. 1 and 14, the surfaces that are exposed when the unit 10 is completely folded are not exposed when the unit is completely unfolded. In addition, those surfaces that are exposed when the unit 10 is completely unfolded are not exposed when the unit is completely folded. This allows the display surfaces to remain free from scratching or marring that may occur during shipping of the folded unit. This also enables the exterior surfaces of the unit in its folded state to be made of resilient material capable of withstanding treatment typically given shipping containers.

It should be understood that numerous modifications or alternations may be made to the device without departing from the spirit and scope of the invention as set forth in the appended claims. For example, it is contemplated that many alternative forms of joining the sections of the unit 10 together may be used instead of the hinges described above. Examples of such joining mechanisms include slidable rod or channel assemblies, spring mechanisms, and certain linkage assemblies. Such joining mechanisms are known by those skilled in the art.

It should also be noted that relative terms such as "upper", "lower", "horizontal", "vertical" and the like are used as a matter of convenience to define an internal frame of reference within the display unit, and are not intended to limit the orientation in which the unit may be used.

I claim:

1. A foldable display unit comprising:

a base having a front surface, a top surface and side surfaces, the top surface configured to nestingly receive sections hinged to the base;

the base further comprises a storage area therewithin, the storage area being accessible from an opening located on a rear surface of the base;

a front section hingedly connected to the base and dimensioned to be nestingly received by the top surface of the base; and a top section hingedly connected to the base and dimensioned to be received by the top surface of the base, whereby the front section pivots from the front surface of the base and the top section pivots away from the top surface of the base to form an attractive display unit, and the front section pivots toward the front surface of the base and the top section pivots toward the top surface of the base to form a self-contained shipping container.

2. A foldable display unit comprising:

a base having a front surface, a top surface and side surfaces, the top surface configured to nestingly receive sections hinged to the base;

a side section hingedly connected to the base and extending outwardly from the side surface of the base when the unit is unfolded, the side section configured to conform to the shape of the side of the base when the unit is folded;

the side section comprising:

a lower portion hingedly connected to the base;

an upper portion hingedly connected to the lower portion and capable of rotating 180° from the lower portion; and a locking means for locking the upper portion in position relative to the lower portion, whereby the side section is folded by pivoting the upper portion approximately 180° so that the upper and lower portions are in adjacent, face to face relation, and the lower portion pivots toward the side surface of the base so that the base and side sections are adjacent;

a front section hingedly connected to the base and dimensioned to be nestingly received by the top surface of the base;

a top section hingedly connected to the base and dimensioned to be received by the top surface of the base, whereby the front section pivots from the front surface of the base and the top section pivots away from the top surface of the base to form an attractive display unit, and the front section pivots toward the front surface of the base and the top section pivots toward the top surface of the base to form a self-contained shipping container.

3. The foldable display unit of claim 2 wherein the lower portion of the side section is hingedly connected to the base by means of an adjustable hinge.

4. A method of folding a display unit into a portable self-contained shipping container, comprising the following steps:

causing a front section hingedly connected to a base, to rotate from a position away from the base toward the base so that the base and front section are nesting relation thereto;

dimensioning the front section so that the front section remains within the dimensions of the base when the base and front section are in nesting relation thereto, the base having front, side, top and rear surfaces;

causing a side section hingedly connected to the base to rotate from a position away from the side surface of the base toward the side surface of the base so that the side section is face to face relation with the side surface of the base;

dimensioning the side section so that the side section remains within the dimensions of the side surface of the base when the side section is folded;

the side section comprising a lower portion hingedly connected to the base and an upper portion hingedly connected to the lower portion and capable of rotating upwardly 180° relative to the lower portion, the upper portion and lower portion dimensioned so that the upper and lower portions remain within the dimensions of the side surface of the base when the side section is folded; and a locking means for locking the upper portion in position relative to the lower portion;

causing a top section hingedly connected to the base to rotate from a position away from the top surface of the base toward the top surface of the base so that the top section and top surface of the base are in nesting relation thereto; and dimensioning the top section so that the top section remains within the dimensions of the base when the top section and base are in nesting relation thereto.

* * * * *